US005176382A

United States Patent [19]

Hausammann

[11] Patent Number: 5,176,382

[45] Date of Patent: Jan. 5, 1993

[54] LOGICAL TOY

[75] Inventor: Christoph Hausammann, Bern, Switzerland

[73] Assignee: Joker SA/AG, Kerzers, Switzerland

[21] Appl. No.: 236,359

[22] PCT Filed: Nov. 9, 1987

[86] PCT No.: PCT/CH87/00151

§ 371 Date: Jul. 23, 1990

§ 102(e) Date: Jul. 23, 1990

[87] PCT Pub. No.: WO88/03827

PCT Pub. Date: Jun. 2, 1988

[51] Int. Cl.[5] ..... A63F 9/08

[52] U.S. Cl. ..... 273/153.5; 273/113

[58] Field of Search ..... 273/153 S, 155, 113, 273/115, 111

[56] References Cited

U.S. PATENT DOCUMENTS

| | | | |
|---|---|---|---|
| 3,677,547 | 7/1972 | Hicks | 273/153 S |
| 3,814,433 | 6/1974 | Mellor | 273/153 S |
| 4,376,537 | 3/1983 | Yokoi | 273/153 S |
| 4,413,823 | 11/1983 | Breslow | 273/113 |
| 4,482,154 | 11/1984 | Mizunuma et al. | 273/153 S |
| 4,487,415 | 12/1984 | Wilfong | 273/153 S |
| 4,553,754 | 11/1985 | Wiggs et al. | 273/153 S |

FOREIGN PATENT DOCUMENTS

| | | | |
|---|---|---|---|
| 0048795 | 4/1982 | European Pat. Off. | 273/153 S |
| 3104021 | 12/1982 | Fed. Rep. of Germany | 273/153 S |
| 2145633 | 4/1985 | United Kingdom | 273/153 S |
| 8803827 | 6/1988 | World Int. Prop. O. | 273/153 S |

*Primary Examiner*—V. Millin
*Assistant Examiner*—Steven B. Wong
*Attorney, Agent, or Firm*—Wood, Herron & Evans

[57] ABSTRACT

The logical toy comprises two components (1–2) that are rotatable relative to each other and feature a center part (16, 17) each. Arranged around each center part (16, 17), concentrically, are six hollow cylindrical containers (3–8; 9–14). The container length increases over each adjacent container always by the same amount. Relative to the plane of rotation, the two components are symmetric. In an initial state of order, the containers of one component contain each one to six balls (19, 20, 21, 22, 23, 24) of same color, with the balls of each container pair differing in color. By rotation of the two components relative to each other and tilting the toy, a state of disorder is produced from the initially prevailing state of order. The objective now is to restore the original state of order with the fewest possible steps by suitable relative rotation of the two components and tilting of the toy.

10 Claims, 2 Drawing Sheets

LOGICAL TOY

Figure 1:
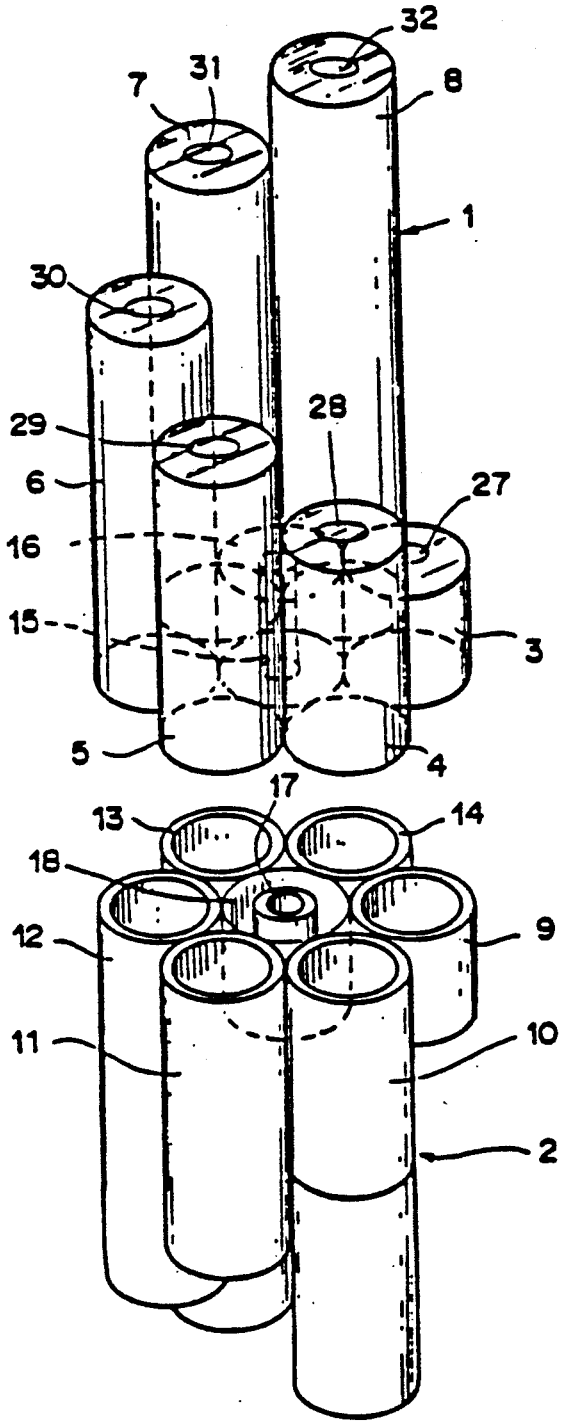

There are prior logical toys that are based on the principle of first creating from an existing order a disorder and to the restore, as much as possible by systematic thought, the initially prevailing order. A logical toy of this type, fashioned as a cube, is described in the Hungarian patent document 170,062. This cube type toy has a mechanically complex structure and, furthermore, the logical thoughts for restoration of the original condition of order are known in broad circles that are interested in such toys, thus negating the enticement to playing with the known toy.

Therefore, one objective of the present invention is to provide a logical toy which mechanically has a simple structure and is inexpensive to manufacture. Additionally, however, principally other logical thoughts shall be required for changing the state of disorder back to a state of order, so that for players who know solutions for the game with the above prior toy the solutions for the game with the newly created toy will not be obvious.

This objective is inventionally accomplished through at least two components which are movable relative to one another and which components comprise each at least two containers for holding at least one organ that can be moved back and forth between one container of the one component and a container of the other component.

Preferred embodiments of the invention derive from the dependent claims.

An embodiment of the invention and its use will be more fully described hereafter with the aid of the drawing.

Figure 2:
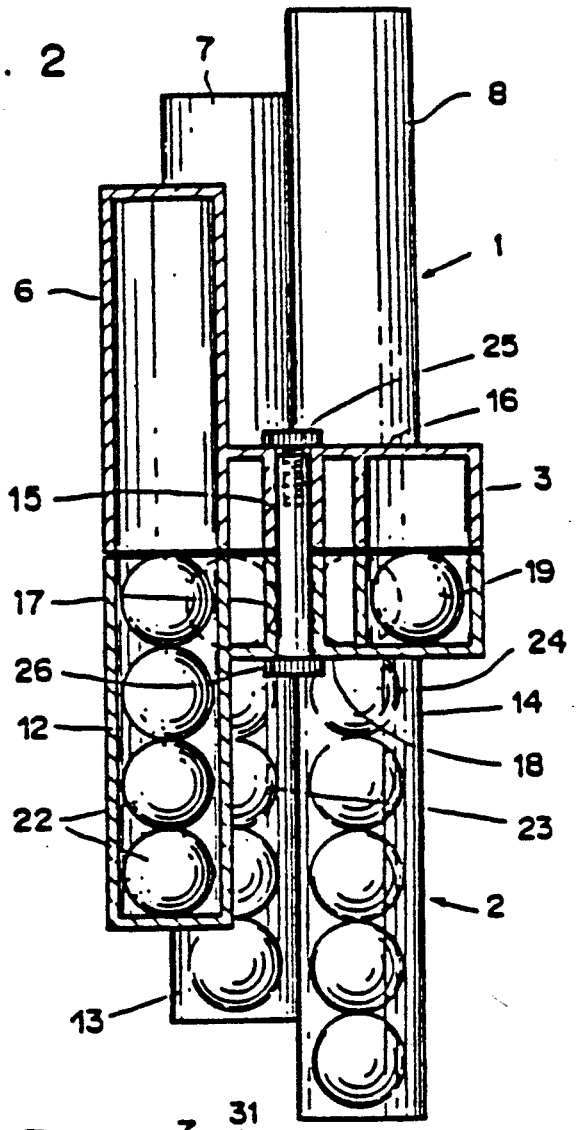
Figure 3:
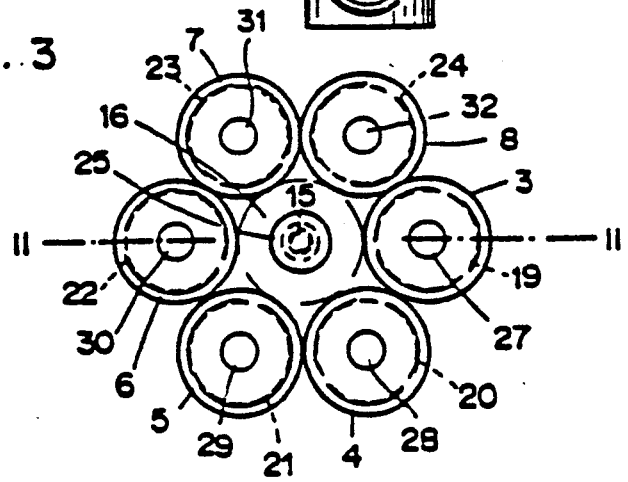

FIG. 1 shows a perspective exploded view of the two toy components provided with containers;

FIG. 2, a longitudinal section along line II—II of FIG. 3;

FIG. 3, a plan view of the toy.

According to the perspective illustration in FIG. 1, the logical toy comprises two components 1 and 2 that comprise each six transparent containers 3–8 and 9–14 having the shape of hollow cylinders. The containers 3–8 are concentrically arranged around a center component 16 provided with a bore 15 and are connected with said center component, for instance by being glued to it or being integral with it. The containers 9–14 of the opposite component 2, which is symmetric with the plane of rotation, are as well arranged concentrically around a center component 18 provided with a bore 17 and are connected with it in the same way. The containers 3–8 and 9–14 of the components 1 and 2, respectively, have the same diameter, with the length of each container increasing relative to the adjacent container by the same amount. The containers 3–8 and 9–14 of the components 1 and 2 are open on opposing ends, whereas their ends are sealed. In the assembled condition of the toy, however, with the two components 1 and 2 fastened in a way permitting their twisting relative to one another and with the containers 3 and 9, 4 and 10, 5 and 11, 6 and 12, 7 and 13 as well as 8 and 14 opposing each other, the two components are symmetric with regard to the plane of rotation.

On their outer, sealed end, the hollow cylindrical containers 3–8 and 9–14 are provided with colored markings 27, 28, 29, 30, 31 and 32 which correspond with the colors of the balls that are contained in the containers of a component.

Illustrated in FIG. 2 is a longitudinal section along line II—II in FIG. 3 while FIG. 3 shows a plan view of the toy according to FIG. 2. The sectional plane extends centrally through the containers 3 and 6 as well as 9 and 12. A white ball 19 is provided in the container 9 while the container 10 holds two black balls 20, container 11 three green balls 21, container 12 four red balls 22, container 13 five yellow balls 23 and container 14 six blue balls 24. Naturally, the colors of the balls might be chosen differently. In the arrangement, the toy is in a state of order, i.e., in the starting or concluding position. The balls could also be marked using for instance numerals or letters or other symbols for differentiation. The two center parts 16 and 17 are held together by a screw 25 and nut 26, rotatable relative to each other. In the starting or ending position, the balls are thus in a state of order, i.e., a container of component 1 or 2 always contains balls of same color. To change the balls over in a state of disorder, the two components 1 and 2 are rotated relative to each other so that no longer two equally long containers will oppose each other. Next, the toy is tilted over permitting the balls from component 2 to proceed at least in part into component 1. Now, the two components 1 and 2 are rotated in a third relative position followed by tilting the toy over so that at least part of the balls from component 1 will proceed back into component 2. The rotational and tilting motions are continued until the desired state of disorder, i.e., an optimal mixing of various ball colors is obtained in the individual containers of components 1 and 2. The objective now is to restore the original state of order, i.e., the condition where only balls of one color or marking are contained in a container of a component, through selecting the proper steps of rotating the components 1 and 2 relative to each other and properly tilting the toy. In the end position, upon successful completion of the game, container 3 or 9 contains a white ball, container 4 or 10 two black balls, container 5 or 11 three green balls, container 6 or 12 four red balls, container 7 or 13 five yellow balls and container 8 or 14 six blue balls, depending on whether component 1 or component 2 is in the down position.

Naturally, it is possible to reduce or enlarge the number of containers per component, change their length and also choose a different number of balls per container part. Conceivable, for instance, is an embodiment where only one part has containers that are graduated in length or volume, whereas the other has containers of equal length and volume. In this embodiment, on the component with containers of different length at least part of them need to have a length that differs from the other containers, making the game then considerably simpler than in the case of the embodiment described and shown in the drawing.

I claim:

1. A puzzle toy comprising two parts mounted on opposite sides of a plane of contact for rotation relative to one another about a common axis perpendicular to said plane, each part including a series of containers, each container being parallel to said common axis and having a closed end and an open end, said parts being rotationally alignable so that the open end of a container of one part can communicate with the open end of a container of the other part, a number of play elements movable within the containers, containers of at least one part being sized to accommodate different numbers of play elements than other containers of said part, the elements in a container of either part being movable through its said open end into an unfilled container of the other part by rotating a part to align such containers with one another and by tipping said common axis about a horizontal position, the containers of the respective parts being arranged so that if any container of one part is aligned with any container of the other part, then all of the containers of said one part are aligned with all the containers of the other part and play elements in multiple containers can simultaneously be transferred between the containers of either part to the other, and so that if any container of one part is not aligned with any container of the other part, then none of the containers is aligned and no elements can be transferred from either part to the other part.

2. The puzzle toy of claim 1 wherein each container of a part is sized to accommodate different numbers of said elements than the other containers on that part.

3. The puzzle toy of claim 1 wherein the total number of said elements is just sufficient to fill all the containers of one said part but none of the containers of the other part.

4. The puzzle toy of claim 3 wherein for each container of one part there is a container of equal volume in the other part, the total volume of the containers of one part being substantially equal to that of the containers of the other part.

5. The puzzle toy of claim 1 wherein play elements are identified by different identification means.

6. The puzzle toy of claim 5 wherein groups of elements have identification means that correspond with a particular container.

7. The puzzle toy of claim 6 wherein each container has identification means corresponding to that of a group of elements having a total volume sufficient to substantially fill the respective container.

8. The puzzle toy of claim 1 wherein the containers of each part have volumes which progressively differ, each container of a given part being sized to hold a different number of elements than the containers adjacent to it in said part.

9. The puzzle toy of claim 1 wherein the containers of each part have volumes which differ progressively by an amount corresponding to the volume of a single element.

10. The puzzle toy of claim 1 wherein each said part is reflectively symmetrical about said plane of contact.

* * * * *